US007959034B2

(12) United States Patent
Faaborg et al.

(10) Patent No.: US 7,959,034 B2
(45) Date of Patent: Jun. 14, 2011

(54) LIQUID PRODUCT POURING AND MEASURING PACKAGE WITH DRAIN-BACK SPOUT FITMENT AND TIGHT-SEALING MEASURING CUP ASSEMBLY

(75) Inventors: Joel Faaborg, Phoenix, AZ (US); Keith Cardinal, Gilbert, AZ (US); Anthony R. Miller, Pittsburgh, PA (US); Ronald Hedman, Crystal Lake, IL (US)

(73) Assignee: The Dial Corporation, Scottsdale, AZ (US)

( * ) Notice: Subject to any disclaimer, the term of this patent is extended or adjusted under 35 U.S.C. 154(b) by 937 days.

(21) Appl. No.: 11/893,688

(22) Filed: Aug. 17, 2007

(65) Prior Publication Data

US 2009/0045224 A1 Feb. 19, 2009

(51) Int. Cl.
*B67D 1/16* (2006.01)

(52) U.S. Cl. ..... 222/109; 222/111; 222/568

(58) Field of Classification Search ..... 222/23, 222/109, 111, 551, 568; 148/381; 215/44; 141/381

See application file for complete search history.

(56) References Cited

U.S. PATENT DOCUMENTS

| | | | |
|---|---|---|---|
| 2,601,040 | A | 6/1952 | Livingstone |
| 2,743,844 | A | 5/1956 | Livingstone |
| 2,763,402 | A | 9/1956 | Livingstone |
| 2,763,403 | A | 9/1956 | Livingstone |
| 2,808,964 | A | 10/1957 | Radtke |
| 3,369,710 | A | 2/1968 | Lucas |
| 4,078,700 | A | 3/1978 | Hidding |
| 4,128,189 | A | 12/1978 | Baxter |
| 4,550,862 | A | 11/1985 | Barker et al. |
| 4,671,421 | A | 6/1987 | Reiber et al. |
| 4,696,416 | A | 9/1987 | Muckenfuhs et al. |
| 4,706,829 | A | 11/1987 | Li |
| 4,773,560 | A | 9/1988 | Kittscher |
| 4,830,234 | A | 5/1989 | Odet |
| 4,836,419 | A | 6/1989 | Metz et al. |
| 4,863,067 | A | 9/1989 | Krall |
| 4,890,770 | A | 1/1990 | Haga et al. |
| 4,917,268 | A | 4/1990 | Campbell et al. |
| 4,917,269 | A | 4/1990 | Fuchs et al. |
| 4,917,270 | A | 4/1990 | Simon |
| 4,974,749 | A | 12/1990 | Mon |
| 4,981,239 | A | 1/1991 | Cappel et al. |
| 4,984,714 | A | 1/1991 | Sledge |
| 4,993,605 | A | 2/1991 | Del'Re |

(Continued)

*Primary Examiner* — Kevin P Shaver
*Assistant Examiner* — Jonathan Wood
(74) *Attorney, Agent, or Firm* — Paul A. Pappalardo

(57) ABSTRACT

An improved dispensing package for liquids is described comprising a combination pouring spout fitment, a closure that functions as a measuring cup when removed and inverted, and a bottle. The improved liquid seal between the closure and the fitment is made possible through mismatched bevels on the closure and fitment respectively wherein the sharper angled bevel on one of the parts buries into the wider angled bevel of the other part. The applied torque is prevented from loosening prematurely through a thread configuration form that allows the closure to seat securely into the spout fitment with the closure threads pushing back up against the bottom surfaces of the fitment threads in a "locked" arrangement. The correct alignment of the fitment on the bottle is made possible through the coordination of a thread stop on the fitment and corresponding locking lug on the neck of the bottle. Lastly, an indicia means is used on the outside of the fitment skirt to verify that the spout fitment and closure subassembly has been correctly orientated on the bottle even through the direction of the spout is obscured when the closure is in place.

5 Claims, 12 Drawing Sheets

U.S. PATENT DOCUMENTS 5,058,772 A 10/1991 Moore et al.
5,108,009 A 4/1992 Davidson et al.
5,114,659 A 5/1992 Krall
5,131,566 A 7/1992 Bavegems
5,207,356 A 5/1993 Krall
5,234,130 A 8/1993 Benioff et al.
5,251,788 A 10/1993 Moore
5,431,306 A 7/1995 Reid
5,435,467 A * 7/1995 Ekkert et al. ..... 222/109
5,454,476 A 10/1995 King et al.
5,462,202 A 10/1995 Haffner et al.
5,566,862 A 10/1996 Haffner et al.
5,597,090 A 1/1997 Leahy
5,603,787 A 2/1997 Reid
5,711,442 A * 1/1998 Kusz ..... 215/209
5,769,254 A * 6/1998 King et al. ..... 215/330
5,794,803 A 8/1998 Sprick
5,855,299 A 1/1999 Arnold et al.
5,941,422 A 8/1999 Struble
6,015,054 A * 1/2000 King et al. ..... 215/44
6,032,829 A 3/2000 Geisinger et al.
6,123,231 A 9/2000 Geisinger
6,209,762 B1 4/2001 Haffner et al.
6,223,945 B1 5/2001 Giblin et al.
6,223,946 B1 5/2001 Geisinger et al.
6,279,789 B1 8/2001 Krall
6,375,041 B1 4/2002 Klima et al.
6,398,076 B1 6/2002 Giblin et al.
6,431,401 B1 8/2002 Giblin et al.
6,464,106 B1 10/2002 Giblin et al.
6,659,310 B1 12/2003 Wolpert
6,923,341 B2 8/2005 Smith
6,964,359 B1 * 11/2005 Darr et al. ..... 222/570
7,097,076 B1 * 8/2006 Giblin et al. ..... 222/109
7,686,188 B2 * 3/2010 Stebick et al. ..... 222/109
2005/0139609 A1 * 6/2005 Giblin et al. ..... 222/109
2005/0230440 A1 * 10/2005 Gilbertson et al. ..... 222/570
2006/0131330 A1 * 6/2006 Stebick et al. ..... 222/109
2007/0194047 A1 * 8/2007 Tauber et al. ..... 222/109
2008/0164282 A1 * 7/2008 Szekely et al. ..... 222/111

* cited by examiner

LIQUID PRODUCT POURING AND MEASURING PACKAGE WITH DRAIN-BACK SPOUT FITMENT AND TIGHT-SEALING MEASURING CUP ASSEMBLY

FIELD OF INVENTION

The invention relates to containers for liquid products such as household detergents and in particular to a liquid container with an improved fitment and measuring cup/closure assembly wherein the cup securely seals into the fitment with minimal applied torque.

BACKGROUND

Liquid containers featuring drain-back spout fitments and closures that double as measuring/dosing cups are very well known in the packaging industry and are widely used for many consumer liquid detergent products, especially liquid laundry detergents and fabric softeners. The basic premise behind this universally recognized package is the merger of three plastic parts, namely a bottle with an opening, a drain-back pour spout fitment fitted into the opening, and a threaded measuring cup that can be inverted and screwed over the drain-back spout to close the container. The packaging industry has improved these packaging components over the years for cost, better functionality, ease of assembly on filled containers, and ease of use for the consumer. However, in spite of continual modifications to this type of liquid packaging, problems with the packaging still remain and a need for continued improvement exists. The changes over the years focused on improvements to dripping, double pouring, slow drain-back, and poor sealing between the bottle and the fitment and between the fitment and the closure. None of these modifications improve (1) the sealing between the closure and the fitment when only minimal torque is applied by a consumer who replaces the closure, (2) maintenance of that torque applied to the closure such that the seal between the closure and fitment can be held between consumer uses, and (3) locking of the fitment onto the bottle in the correct orientation with respect to the way the consumer will hold and lift the bottle (e.g., foolproof orientation of the pour spout such that it aims to the direction the bottle is designed to pour).

The basic liquid package with drain back feature may be found in U.S. Pat. No. 4,550,862 issued to The Procter & Gamble Company in 1985 (Barker). Since then, various improvements to this basic concept can be seen throughout the past two decades or so.

U.S. Pat. No. 4,696,416 (issued to Muckenfuhs) incorporated a "drip concentrator" at the drain back hole such that residual liquid would coalesce and drip back into the bottle. This reduced some of the messiness of these systems by collecting and draining back residual liquid more efficiently.

U.S. Pat. No. 4,917,268 (issued to Campbell) claimed improvements to the centering and fit of the pouring spout fitment into the bottle opening through use of a plurality of teeth inter-engaging with cooperating ramp projections.

U.S. Pat. No. 5,058,772 (issued to Moore) claimed improvements to the sealing between the spout fitment and the bottle opening lip by incorporating a "V"-shaped slot up underneath the fitment skirt that engages with the lip of the bottle opening. Moore has also described leveling formations on the bottom of the fitment to facilitate automated assembly.

U.S. Pat. No. 5,251,788 (also issued to Moore) claims improved pouring and drain back through an offset spout with a uniquely contoured pouring lip.

U.S. Pat. No. 5,431,306 (issued to Reid) focusing on the seal between the fitment and the neck of the bottle. The design of the fitment and the neck allow for ultrasonic welding between these two melt-flow compatible surfaces.

U.S. Pat. Nos. 5,462,202 and 5,566,862, (issued to Haffner), claim modification to the basic drain back packaging system. The cap features a collar with internal threads that are designed to close completely over the neck of the bottle. However, the fitment has limited sealing surfaces to the opening of the container since there are no threads. Leakage is possible around the cap threads and out to the outer circumference of the neck and this system is prone to the spout fitment falling back inside the bottle.

U.S. Pat. No. 5,603,787 (issued to Reid) claims a better seal between the spout fitment and the neck of the bottle using an ultrasonic weld between the surfaces.

U.S. Pat. Nos. 6,032,829 and 6,223,946, (issued to Geisinger), claim an improved seal through the deformation of a v-shaped rib on the neck of the bottle with a circumferential flange around the skirt of the cap. In this invention, the cap seals against the top edge of the neck of the bottle rather than onto the spout fitment. The spout is molded as an integral part of the bottle and not attached as a separate fitment.

U.S. Pat. No. 6,279,789 (Krall), U.S. Pat. No. 6,398,076 (Giblin), U.S. Pat. No. 6,659,310 (Wolpert) and U.S. Pat. No. 6,923,341 (Smith) claim further improvements to the basic drain back spout package, incorporating various designs for sealing of the cap to either the neck of the bottle or to the spout fitment, (one of which includes spin-welding), improving the pouring and the drain back efficiency, or making the closure child-resistant.

SUMMARY OF THE INVENTION

In general, and by way of summary description and not by way of limitation, the present invention accomplishes (1) improved sealing between the closure and the fitment when only minimal torque is applied by a consumer who replaces the closure, (2) maintenance of the torque applied to the closure such that the seal between the closure and fitment can be held between uses, and (3) locking of the fitment onto the bottle in the correct orientation with respect to the way the consumer will hold and lift the bottle (e.g., foolproof orientation of the pour spout such that it aims to the direction the bottle is designed to pour) with indicia means to verify the proper orientation.

As will be described in detail below, the present invention is an improved dispensing package for liquids comprising a spout fitment, closure that functions as a measuring cup and a bottle. The improved liquid seal between the closure and the spout fitment is made possible through mismatched beveled surfaces on the closure and fitment respectively, wherein the sharper angled surface on one of the parts buries into the wider angled surface of the other part. The applied torque is held through a thread configuration form that allows the closure to seat securely into the spout fitment with the closure threads pushing back up against the bottom surfaces of the fitment threads in a "locked" arrangement. The correct alignment of the fitment on the bottle is made possible through the positioning of a thread stop on the fitment and corresponding locking lug on the neck of the bottle. Lastly, an indicia means is used on the outside of the fitment skirt to verify that the spout fitment and closure subassembly has been correctly orientated on the bottle even through the direction of the spout is obscured by the seated closure.

DETAILED DESCRIPTION OF THE INVENTION

Figure 1:
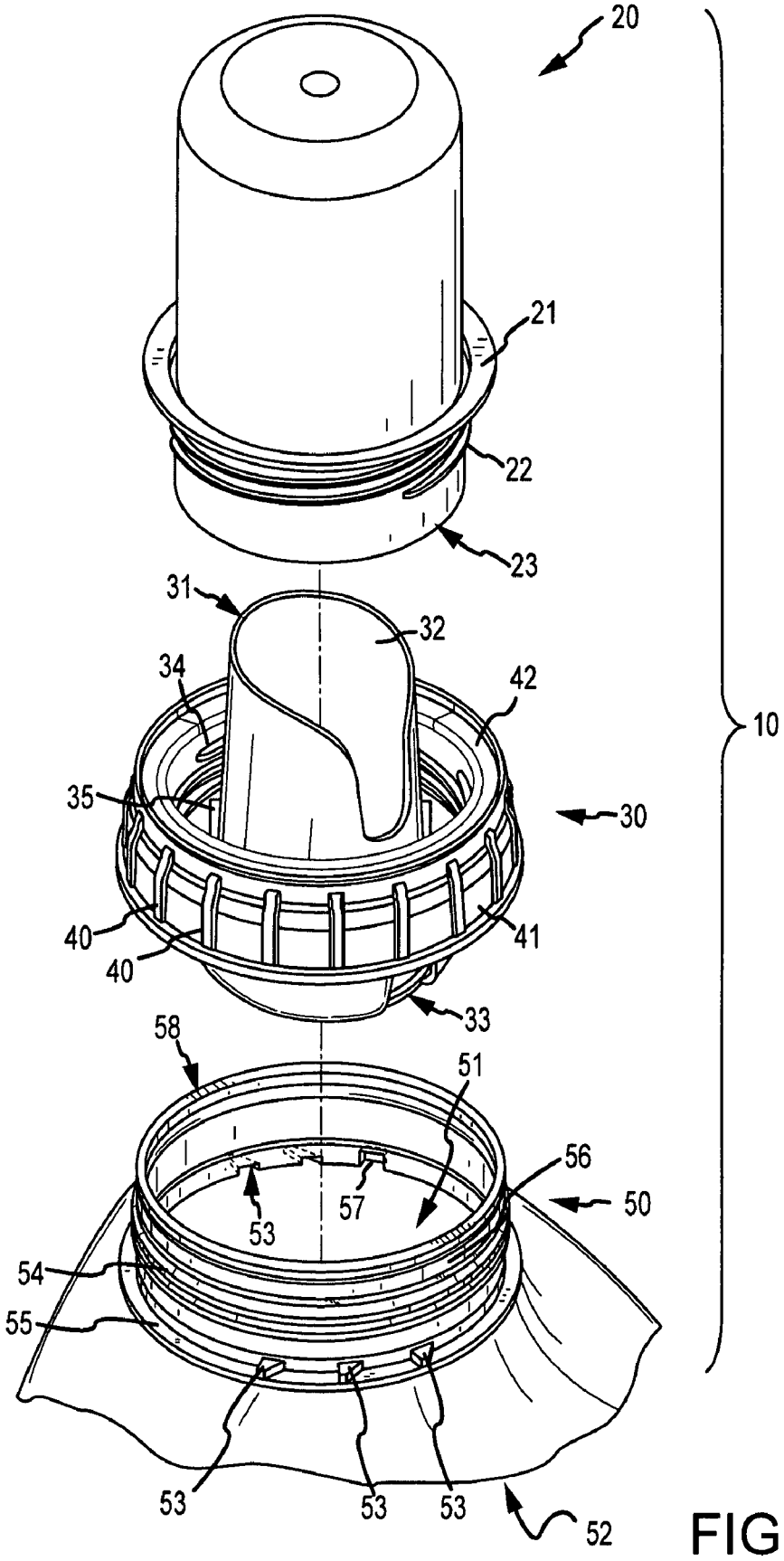
FIG. 1 represents an exploded perspective view of the present invention that is an improved package for liquids comprising a cup/closure, a fitment that doubles as a pouring spout and a bottle with neck configured to accept the fitment.

The present invention is shown in a perspective/exploded view in FIG. 1, wherein three basic parts, namely a closure/measuring cup 20, a pouring spout fitment 30 and a bottle 50, come together to form the improved storage and dispensing package 10 of the present invention As shown in FIG. 1, a bottle 50, having a hollow body portion 52 for containerizing liquids, also comprises an opening 51 that finishes into a substantially vertical projecting neck 56 circumscribing opening 51. The neck 56 is preferably finished with external threads 54 and ends at an uppermost edge 58. A radially projecting peripheral shoulder 55 is located at the base of the neck and is preferably provided with at least one anti-rotation tooth 53. In this perspective view, additional anti-rotation teeth 53 may be seen inside the bottle opening 51 from their backsides (i.e., as indentations since they project out the opposite side of the bottle from this view). Also a single rectangular shaped locking lug 57 may be seen from its backside as well since in this view it is projecting out from the other side of the neck of the bottle.

Also referring to FIG. 1, the liquid storage and dispensing container 10 of the present invention includes a closure 20 that doubles as a measuring cup. The salient features of the closure 20 include a flange 21 that circumscribes the closure and external threads 22 positioned below the flange. The flange 21, (described in detail below), forms part of the sealing system between the closure 20 and the fitment 30. The closure/cup ends at a lower edge 23 that is also the pouring lip when the closure 20 is inverted and used as a measuring cup for the containerized liquid.

Also included in the invention, and shown in perspective view in FIG. 1, is a fitment 30 that doubles as the pouring spout. The fitment 30 includes ribs 40 spaced around skirt 41 that may be used as grips when threading the fitment 30 onto the bottle threads 54. Skirt 41 is seen as being the external side to an annular collar of fitment 30. Additionally, the fitment 30 includes pouring spout 32 centrally located within the fitment, an upper pouring lip 31 on the pouring spout, a drain-back hole 33, and internal threads 34 configured to engage with the external threads 22 on closure 20. Also seen in part 30 are a number of anti-nesting ribs 35 that are a preferred addition to the present invention. Lastly, the fitment 30 includes a recessed sealing shelf 42, which is essentially horizontal and circumferentially positioned around the top of the annular collar of the fitment. This shelf is juxtaposed between an inner wall of the fitment where the threads 34 reside, and the external skirt 41, and can be seen as a "flat top" to the annular collar. As will be described in detail, part of the improved sealing of this invention is the seating of flange 21 into shelf 42 when the closure 20 is securely screwed down into fitment 30.

As indicated in FIG. 1, the present invention 10 is an assembly of the three components 20, 30 and 50 to form a package that may be used for storing and dispensing liquids such as household detergents. The preferred assembly is to first make a subassembly of the closure 20 and fitment 30, and then attach that subassembly to the bottle 50 previously filled with a liquid product, with a rotor gripping either the closure 20 or the fitment 30. However, there is no reason why the fitment 30 cannot be first placed on the bottle 50 (with bottle full or empty) followed by securing the closure 20 onto the fitment 30. Normally these pieces are made of plastic and prepared by injection molding and/or injection blow-molding processes. The preferred materials of construction are polyethylene (for example, LDPE or HDPE), although any moldable plastic is viable and other materials may be preferred based on the corrosive or aggressive nature of the liquid toward plastic. Different hardness of plastic may be used in each of the pieces such that one part (the harder plastic part) can dig, deform and seat into another part comprised of the softer plastic in order to improve sealing. The shape of the bottle 50 is not material to the present invention and consequently it may be large or small, and it may or may not feature handles, recesses or other gripping surfaces, depending on the application for the package 10.

Figure 2:
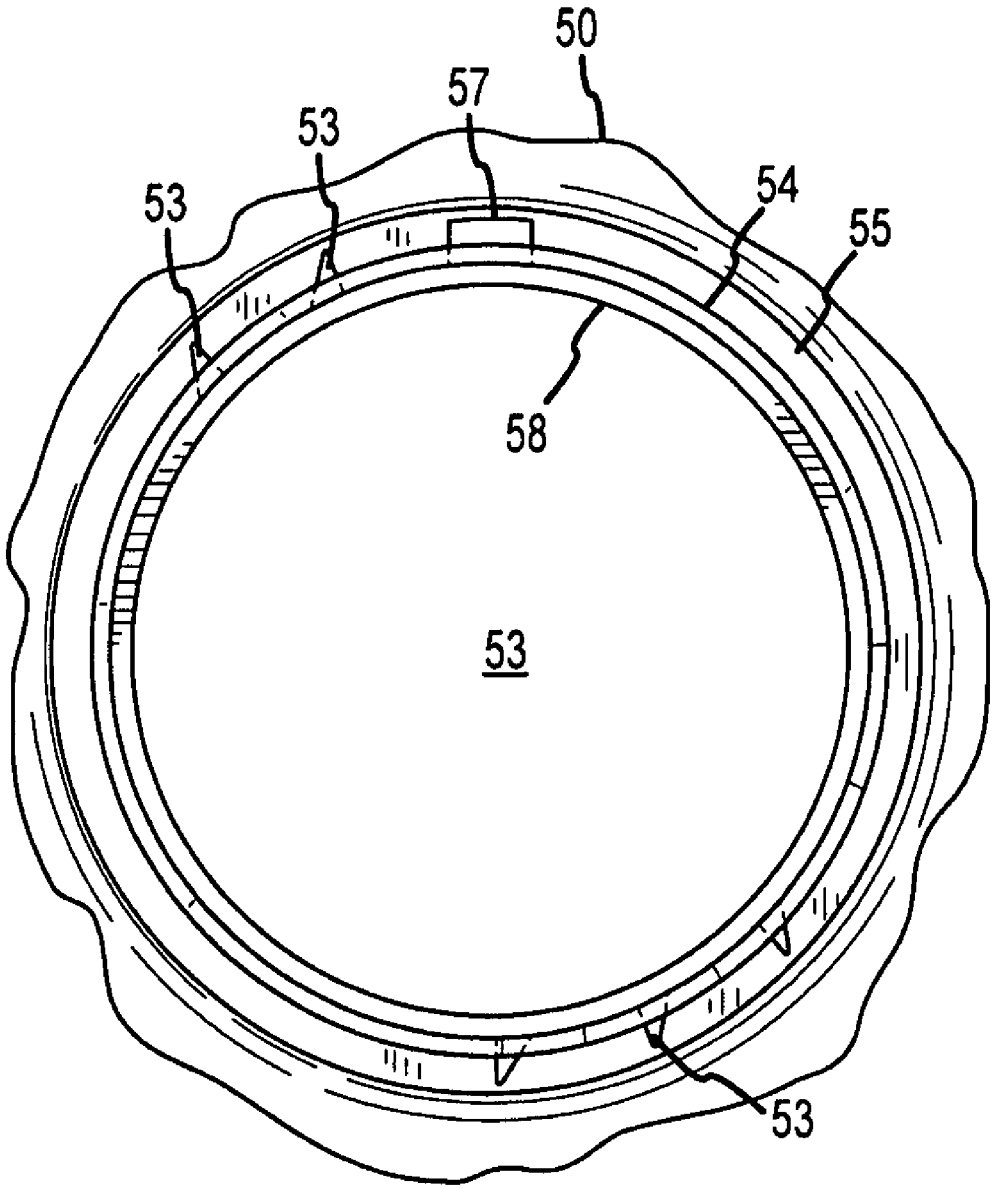
FIG. 2 is a top-down view of the opening of the bottle in the present invention showing various anti-rotation teeth and a locking lug for orienting the fitment on the bottle.

FIG. 2 shows the view down onto the top of the opening 51 of the bottle 50 of the present invention. Visible in this view are the anti-rotation teeth 53, along with a rectangular block shaped locking lug 57, the flat peripheral shoulder 55, external threads 54 and uppermost edge 58. In this preferred embodiment, the anti-rotation teeth 53 are arranged in two groups positioned across from each other around the neck of the bottle. The single locking lug 57 will catch a ridge (or "thread stop") molded into the underside of the skirt 41 of the fitment 30, as will be explained below. As the fitment 30 is screwed down onto the threads 54 of the bottle, the anti-rotation teeth will begin to engage and then in the final tightening of the fitment, the locking lug will engage behind a ridge such that the fitment 30 will be locked into a desired orientation, (for example, with the spout pouring lip 31 aimed opposite to a handle or grip on the bottle).

Figure 3:
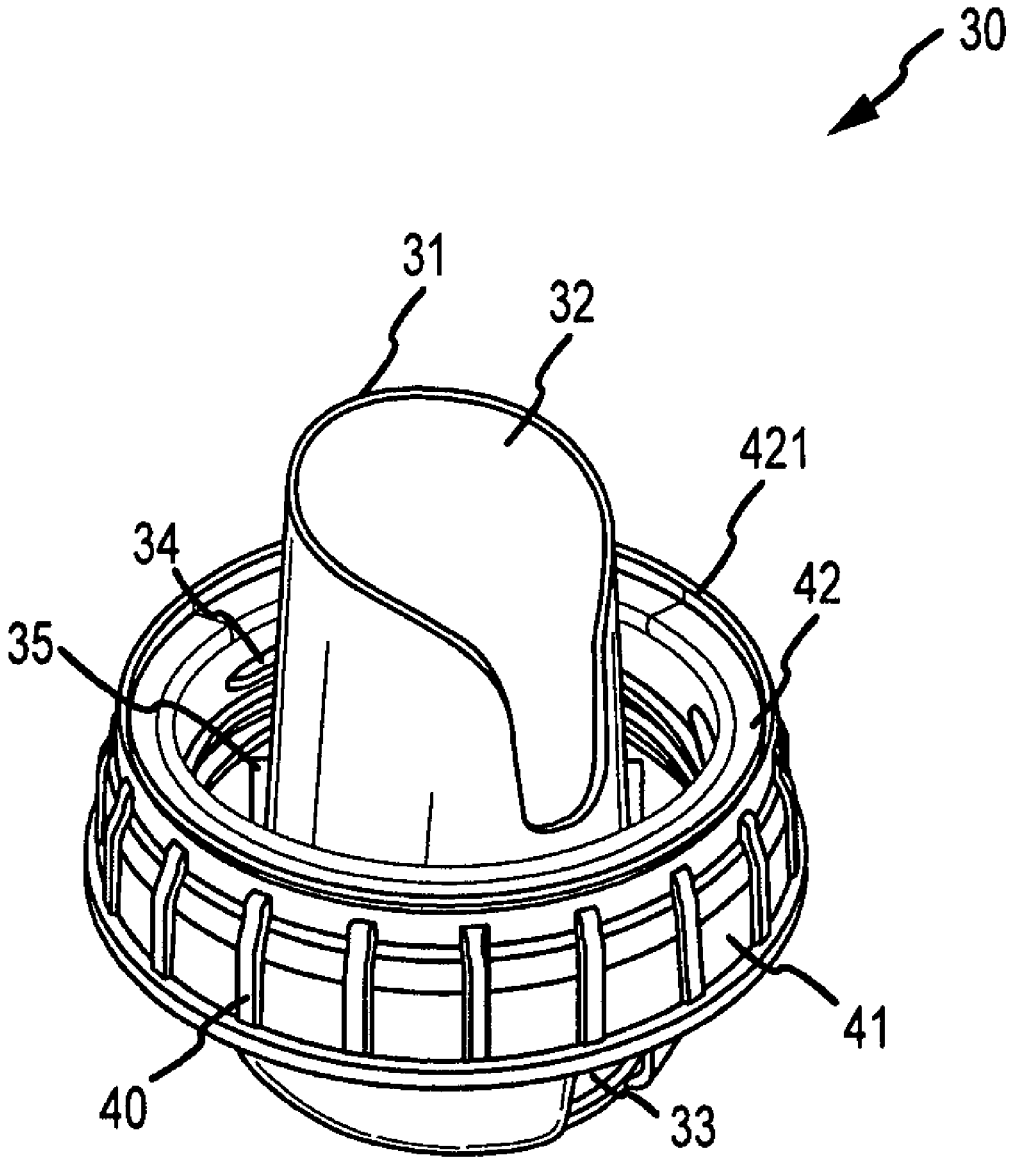
FIG. 3 is a top perspective view of the fitment of the present invention showing a preferred spout design, various gripping ribs used when mounting the fitment on the bottle, and the drain back hole in the bottom of the fitment.
Figure 4:
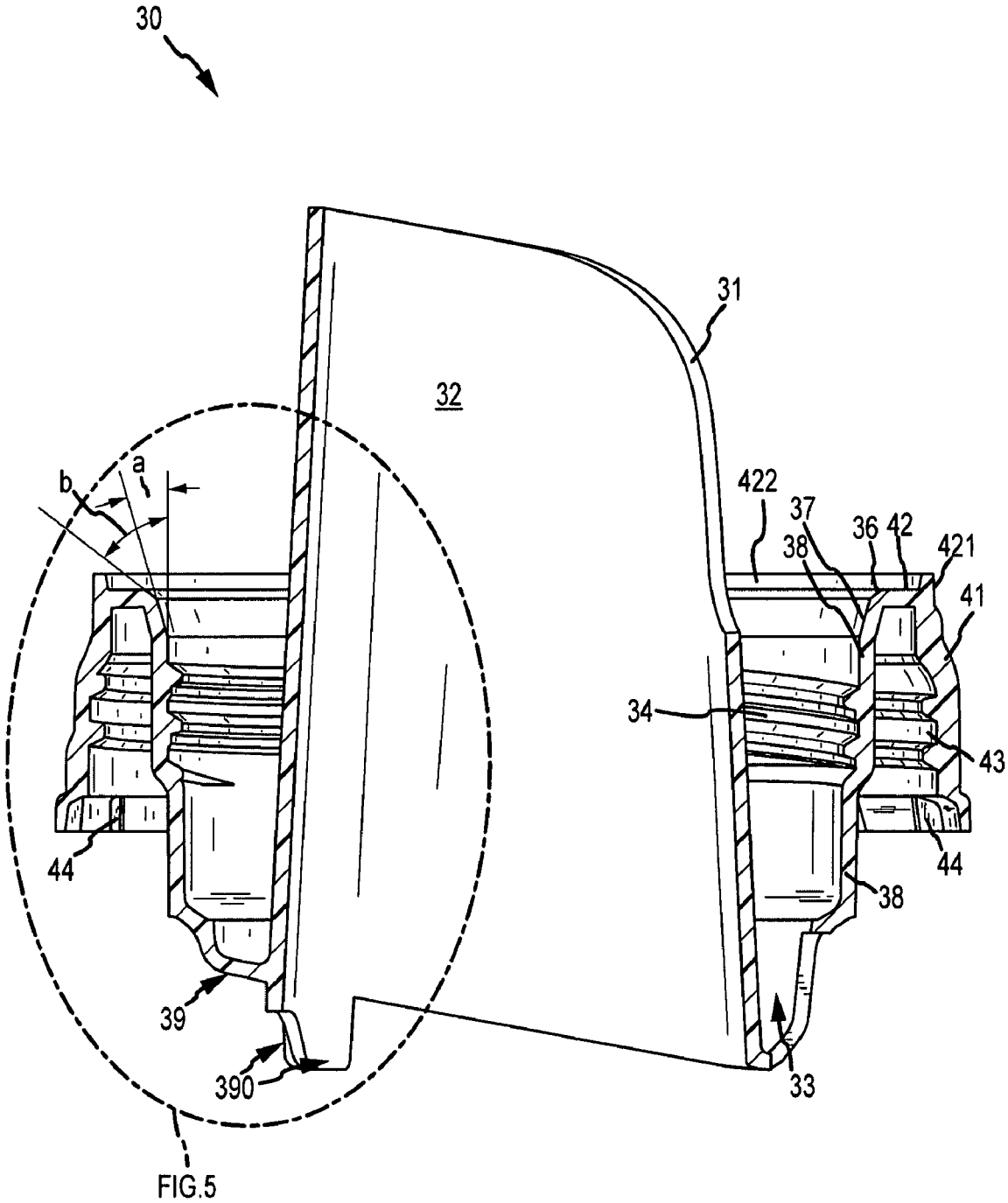
FIG. 4 is a cross-sectional representation of a preferred configuration of the fitment in the present invention showing various thread configurations and sealing surfaces.

FIGS. 3 and 4 depict the fitment 30 of the present invention and more details to the improved sealing possible through this unique design. As detailed in perspective view in FIG. 3, the fitment 30 preferably comprises a pouring spout 32, sealing shelf 42 recessed just below lip 421, annular skirt 41 further comprising gripping and indicia ribs 40, anti-nesting fins 35, internal threads 34 for mating with the cap/closure threads, and drain-back hole 33. The anti-nesting fins 35 can be of any number and size, with even one sufficient in preventing the fitments from jamming together or nesting. More preferred is to have more than one anti-nesting fin and to shape the fins long and narrow. The grip ribs 40 can also be of any number and shape, although at least a few are more efficient for servomotors to grip. These ribs can be any shape and size, and in a preferred embodiment, they are asymmetrically arranged around the skirt such that the asymmetry functions as an indicator to signal the orientation of the spout 32 when the closure is on the fitment and the direction of the spout cannot be ascertained. For example, ribs 40 can be evenly dispersed around the skirt 41 except for at the pouring direction where one rib can be left off as a marker or indicia. Thus when the fitment and closure are secured to the bottle, one quick check of where the "missing rib" is located indicates what direction the spout is pointing. This allows a visual queue to check that the fitment has engaged properly onto the bottle.

Shown in greater detail in the cross-sectional view in FIG. 4, the fitment 30 comprises spout 32 that connects at its lowest point with annular wall 38 through floor or "drain back trough" 39. Trough 39 is sloped as is common (and necessary) for drain back fitments, and the drain hole 33 is positioned at the lowest point of the sloped trough 39. Internal threads 34 are configured on the inner annular wall 38. These internal threads 34 may have the thread profile form depicted in this cross-sectional view, and as will be discussed below, this thread profile is of importance in the improved sealing between the cup/closure and the fitment. Annular wall 38 preferably rolls over and molds contiguously into skirt 41 through a series of angles or bevels that form the basis of the improvement of this invention over the prior art. As mentioned earlier, skirt 41 shares an upper shelf 42 with the inner annular wall as part of an overall annular collar. Depicted now in more detail in this cross-section representation in FIG. 4 is that shelf 42 is recessed to form a lip 421 that resides at the uppermost edge of the skirt 41. The lip 421 of skirt 41 has an inner wall surface 422 that may be used as one sealing surface. It is important to note that the inner surface 422 does not need to be vertical and may be angled and rounded slightly for manufacturability. The horizontal shelf 42 forms a sealing surface, although not the most important one. The bevel 36 is not critical to the sealing but is a transition between the horizontal shelf 42 and the most important sealing surface, bevel 37. Bevel 37 is contiguous with annular wall 38. As will be described in more detail when the fit between the parts is described, the substantially horizontal shelf 42 and the bevel 37 form the two most critical sealing surfaces between the closure 20 and the fitment 30 when these two parts are secured together on their mating threads, with the angle of the bevel 37 being the most critical as it relates to sealing surfaces in the cap/closure.

Referring still to FIG. 4, the angle of bevel 37 from vertical is represented by angle "a". The angle of bevel 36 from vertical is represented by angle "b". As mentioned previously, shelf 42 is substantially horizontal and thus forms approximately a 90° angle from vertical. Angle "a" is preferably from about 1° from vertical to about 20° from vertical. Angle "b" is preferably from about 20° from vertical to about 90° from vertical. In the preferred configuration as shown in FIG. 3, angles "a" and "b" form a two bevel stepwise transition from the substantially vertical annular wall 38 to the substantially horizontal shelf 42. However, in another embodiment, bevel 36 can be eliminated altogether in which case bevel 37 would directly connect annular wall 38 with shelf 42.

Also shown in FIG. 4 are the threads 43 that are underneath skirt 41, which mate with the threads on the neck of the bottle. These threads are for securing the fitment 30 onto the bottle 50, (the bottle not shown in FIGS. 3 or 4). The thread profile form may be such as that depicted in this cross-sectional view. Additionally, anti-rotation notches 44 are seen underneath skirt 41. These notches engage with the previously described anti-rotation teeth preferably positioned at various locations around the neck of the bottle. Lastly, FIG. 4 shows at least one foot 390 that allows the fitment to stand up straight in an automatic loading machine. Foot 390 levels off the bottom of the fitment by aligning up with the lower most portion of the drain-back trough (i.e., the lowest point of the drain-back hole 33). As will be delineated below, the internal threads 34 are cut in an unusual shape that allow the closure/cup 20 to pull down tightly into the seat defined by shelf 42 and bevel 37 of the fitment.

Figure 5:
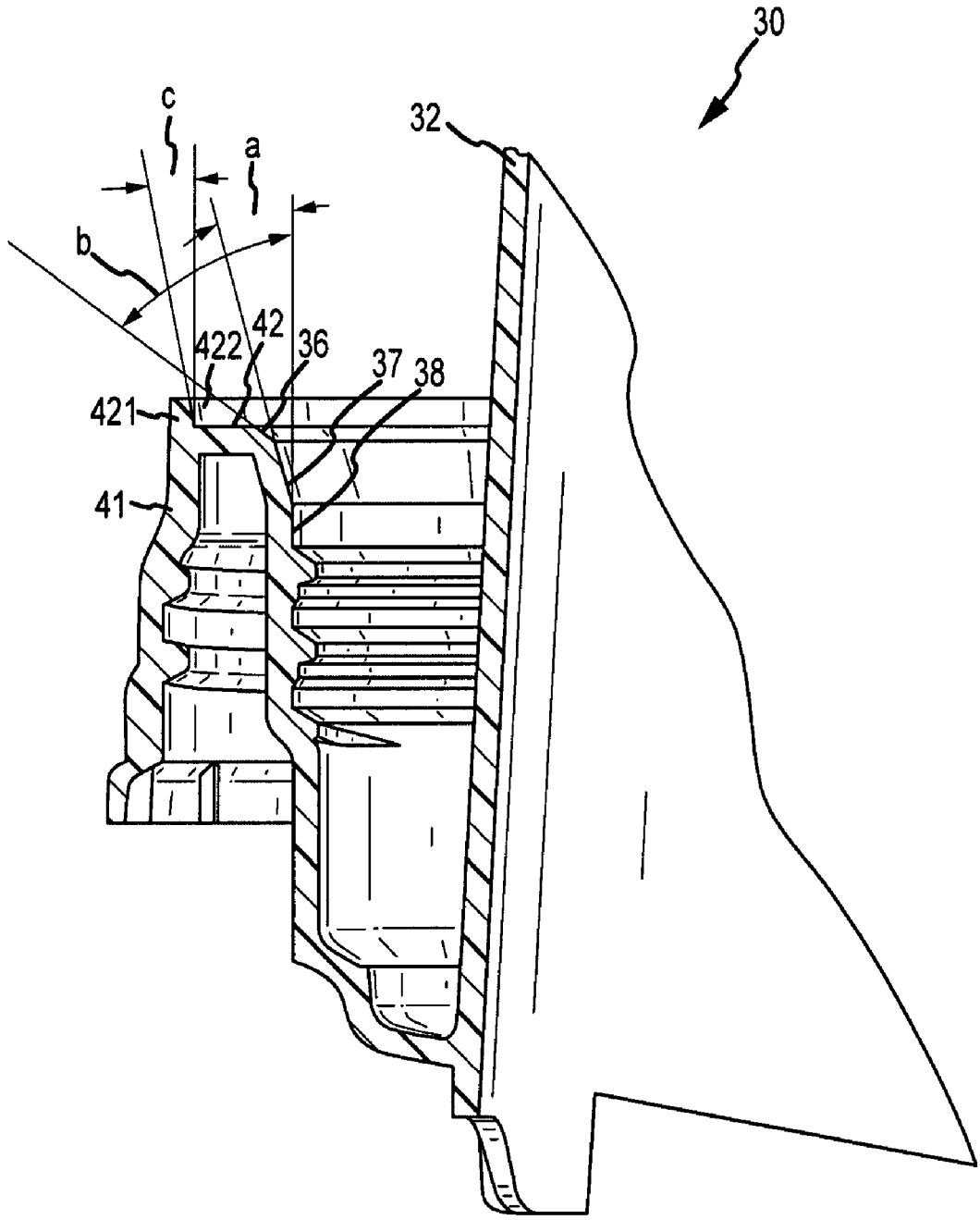
FIG. 5 is an expanded cross-sectional view of one end of the fitment of the present invention, showing bevels that become sealing surfaces between the fitment and cup/closure of the present invention.

FIG. 5 is a cross-section view of an expanded region of FIG. 4 that further elaborates the critical sealing surfaces and angles of the present invention. As shown in sectional view in FIG. 5, substantially horizontal shelf 42 of fitment 30 is recessed below the uppermost lip 421 of skirt 41. This lip 421 preferably has an inner surface 422 that is at an angle "c" off from vertical. This angle "c" is preferably from about 0° (i.e. substantially vertical) to about 45° from vertical. As mentioned above, substantially horizontal shelf 42 links to substantially vertical annular wall 38 through a series of two contiguous bevels, namely 36 and 37. As mentioned previously, bevel 37 is at angle "a" from vertical and bevel 36 is at angle "b" from vertical. Although shelf 42 and bevel 37 form the two most critical surfaces for sealing with the cup/closure, the surfaces 422 and 36 may also come into play as sealing surfaces in this invention that is improved over the prior art, depending on the design of the cup/closure 20.

Figure 6:
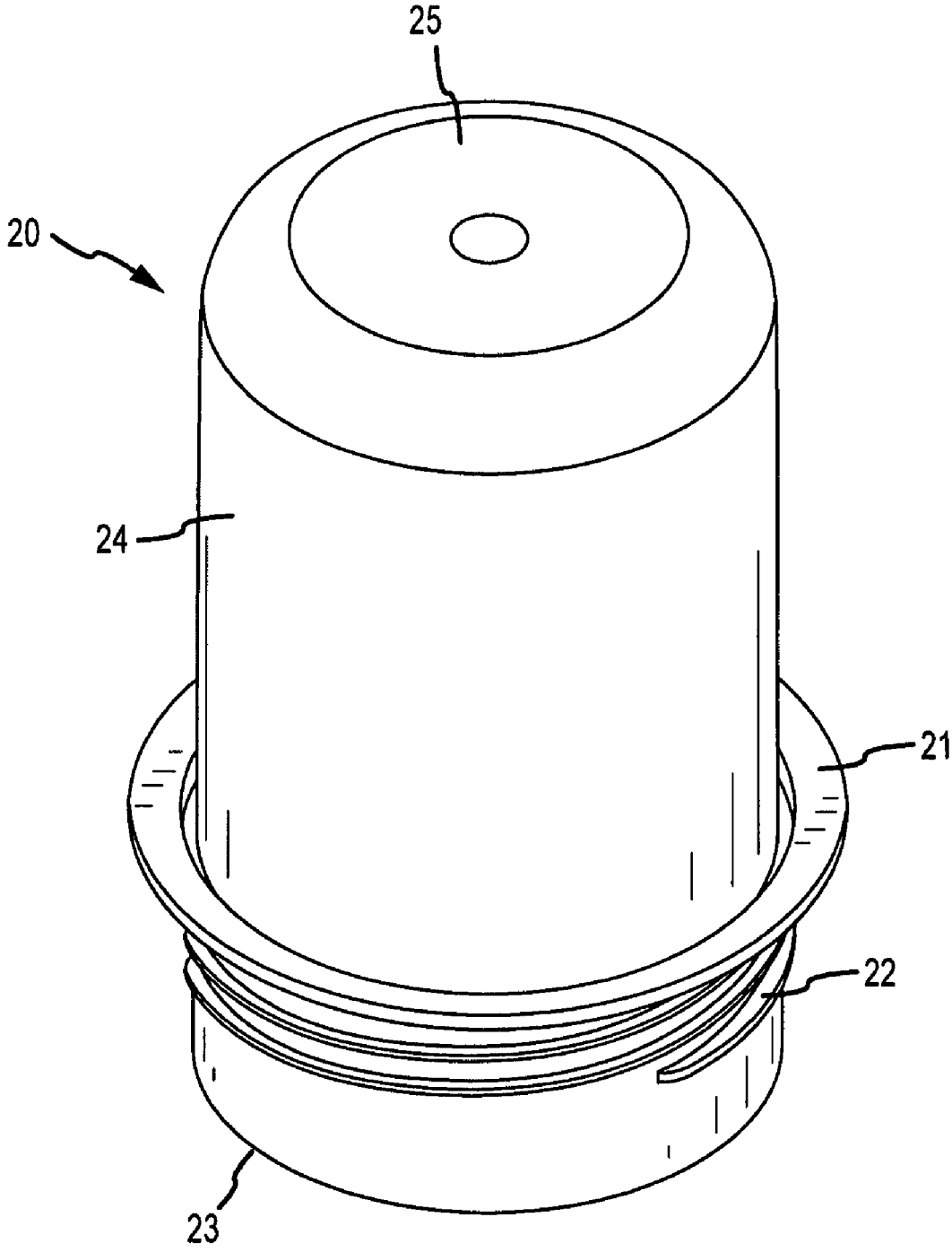
FIG. 6 is a top perspective view of a preferred cup/closure for use in the present invention.
Figure 7:
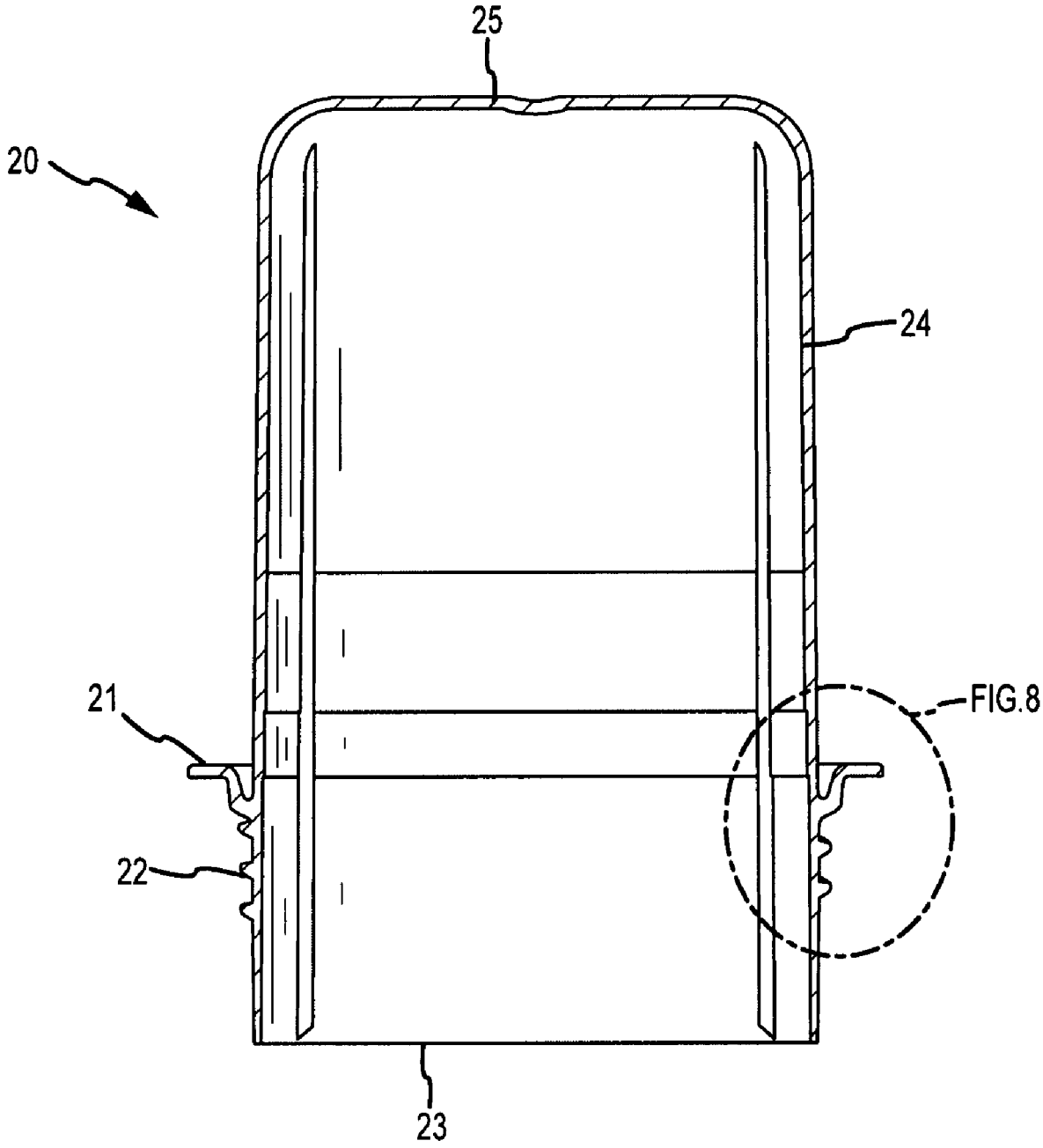
FIG. 7 is a cross-sectional view of a preferred cup/closure in the present invention.
Figure 8:
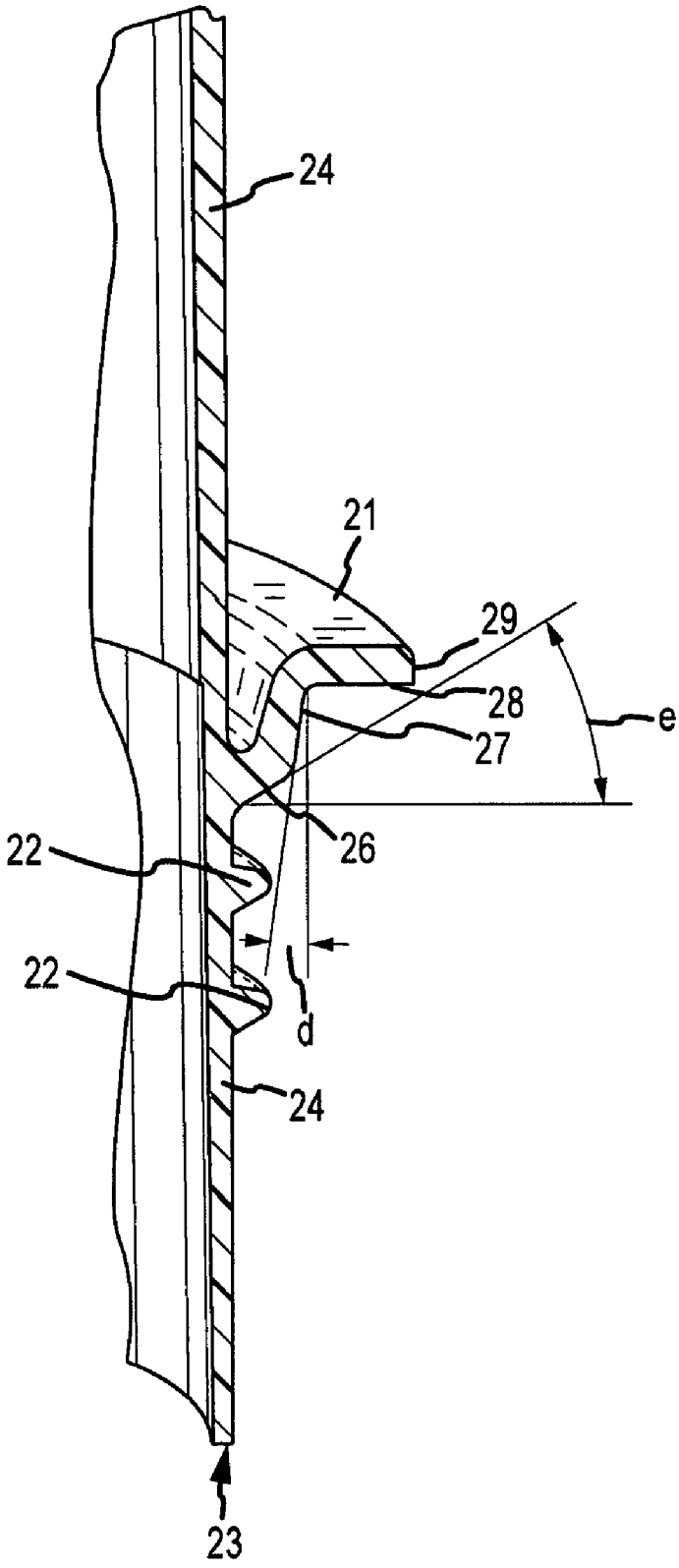
FIG. 8 is an expanded cross-sectional view of one part of the preferred cup/closure of the present invention showing more clearly a circumferential flange that supplies certain sealing surfaces along with external threads that allow mating of the cup/closure with the fitment of the present invention.

A preferred configuration for the closure/measuring cup 20 is detailed in FIGS. 6, 7 and 8. FIG. 6 shows a top perspective view of a preferred closure for the present invention. Closure 20 comprises sidewalls 24, top 25, flange 21, threads 22, and pouring edge 23. As mentioned above, and quite common in the marketplace, these types of closures are intended to be removed by the consumer from the fitment of the bottle and used as measuring cups for dosing the liquid where needed and in the amount needed. Thus, when inverted for use as a measuring cup, the surface 25 necessarily becomes the bottom of the cup, and the sidewalls 24 and the bottom 25 together define a container that can hold liquid. Additional features may be added to the closure 20, both for aesthetic reasons and for convenience and function. For example, a clear plastic viewing window may be added, or measuring graduations marking specific volumes, or other means to aid the consumer with measuring out particular amounts with the cup. The cup/closure may feature gripping features such as ribs, dents, protrusions or rubberized materials around the upper perimeter for assisting the consumer with replacing the closure back on the bottle, or for connecting up to a servomotor for assembling the parts (e.g., fingers of a rotor inserting into appropriately configured slots in the top of the closure). The closure/cup may of course have various design features, such as patterns embossed on either or both of the outside or inside surfaces, or even attached tools such as bristle brushes. Additional features added to the closure/cup do not alter the spirit of the present invention and are certainly within the scope of the invention. As mentioned earlier, this piece, along with the bottle and fitment, are best made of plastic, and a preferred method of manufacturing for these plastic parts is injection molding. The plastic closure/cup 20 may be any color to signal a particular product, brand usage, and emotion, or simply to coordinate in color with the bottle. The closure may also have branding printed or molded on the exterior surface.

FIG. 7 shows a cross-sectional view of the entire preferred cup/closure 20 of the present invention. Closure 20 includes top wall 25, sidewalls 24 (sometimes called an annular skirt wall) and bottom pouring edge 23. The sidewalls 24 are dependent from the top wall 25. The closure also preferably includes circumferential lip or flange 21 molded continuously and protruding radially out from sidewalls 24, along with external threads 22 between the lip 21 and the bottom edge of the cup 23. The threads may have thread profile best seen in later expanded view (FIG. 8). A portion of the cup in FIG. 7 is marked as being expanded in the next figure (FIG. 8).

FIG. 8 is a detail of a portion of the cup/closure of the present invention more clearly showing the salient features and the sealing surfaces. As mentioned above, cup 20 preferably comprises sidewall 24 that further comprises a protruding circumferential lip or flange 21. Lip 21 has an outermost edge 29 and a surface 28 beneath. Depending on the width of the circumferential lip 21, the edge 29 may or may not be designed for an interference fit with the inner surface 422 described above. This interference fit can be brought into play if the width of the lip 21 is engineered to the width of the shelf 42 described above. More importantly, the lip 21 molds back into the sidewall 24 of the cup through a curved and contiguous wall that provides angled surfaces 27 and 26. Thus provided, angled surfaces 27 and 26 connect the substantially horizontal surface 28 underneath lip 29 with the substantially vertical sidewall 24 of the cup. As depicted in FIG. 8, slope 27 is offset from vertical at angle "d" and slope 26 is offset from horizontal by angle "e". Angle "d" is preferably from about 1° from vertical to about 20° from vertical and most importantly, angle "d" is molded at an angle that is different from angle "a" depicted in FIG. 4. Most preferred is that angle "d" is less than angle "a" such that when the cup 20 is screwed down in and mated with fitment 30, sharper angle "d" will crush into the more sloped angle "a" provided in the fitment. This is the most important sealing point in the present invention, and this "mismatched mating" of the angled surfaces 27 and 37 will be described again and in more detail below. As mentioned above, the closure and the fitment can be molded from plastics having different hardness, thus accentuating the deformation when bevel 27 mates with mismatched bevel 37. Not intending to be bound by any theory, it's possible that when surfaces 27 and 37 form their interference fit, the circumferential lip 21 of the cup/closure may be displaced in toward sidewall 24 and slightly up by way of the design shown in FIG. 8. That is, the trough formed by the way the lip is molded on the cup/closure may provide a bending point for the lip to flex or hinge in slightly. The angle "e" of bevel 26 also bears relationship to the sealing of the cup 20 with the fitment 30 in the present invention, since the bevel 26 will abut to a thread surface within the fitment 30. Bevel 26 is the continuation or the transition of bevel 27 with the sidewall 24 of the cup. To avoid confusion, the bevel 27, can be thought of as the "first bevel" and the bevel 26 as the "second bevel", and that the combination of the two bevels 27 and 26 together form a two-step connection between the underside 28 of flange 21 back to the sidewalls 24 of the closure 20 at a point just above the external threads 22. That being said, this angle "e" may be from about 0° from horizontal (i.e., substantially horizontal) to about 60° measured off from horizontal. Obviously the angle "e" cannot be so great as to obliterate the existence of the bevel 27. Thus, the most preferred angle "e" is less than 45° when measured off from horizontal. As will be described below, bevel 26 will abut against the top surface of a thread bead in the fitment. Also shown in FIG. 8 are the threads 22 molded on the exterior surface of the cup 20, which mate with the threads in the fitment. External cup/closure threads 22 may have the thread profile form depicted in this cross-section view of FIG. 8. Although the threads 22 may comprise a single, multi-turn continuous thread, it is more preferred that the threads 22 have at least two and most preferably three starting positions (two to three separate thread turns) so that the consumer can engage the cup back onto the fitment quickly without searching all the way around the circumference of the cup for where the threads may start. With at least two and most preferably three thread starts, the cup is easily engaged onto the fitment, and only ½ turn or less of the cup will fully engage the cup onto the fitment once one of the thread starts is found.

Figure 9:
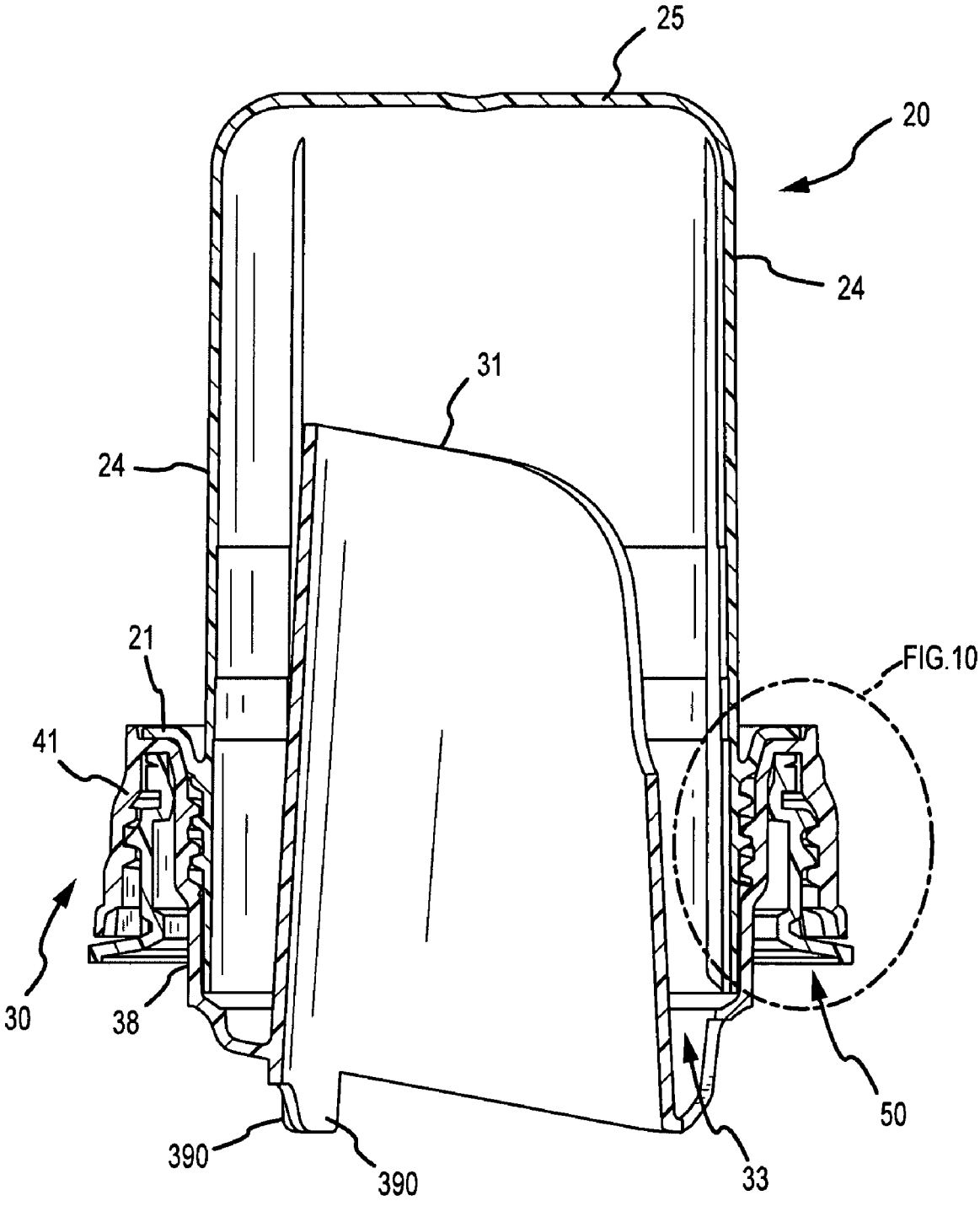
FIG. 9 shows a cross-sectional view of all three elements tightened together; a preferred cup/closure, a preferred fitment, and a preferred neck of a bottle.

FIG. 9 depicts in more detail the complete invention by showing a cross-section of all three pieces, cup/closure 20, fitment 30 and bottle 50, mated together, (this figure only depicts the neck of the bottle 50). FIG. 9 also references a blown-up area that is shown in FIG. 10.

Figure 10:
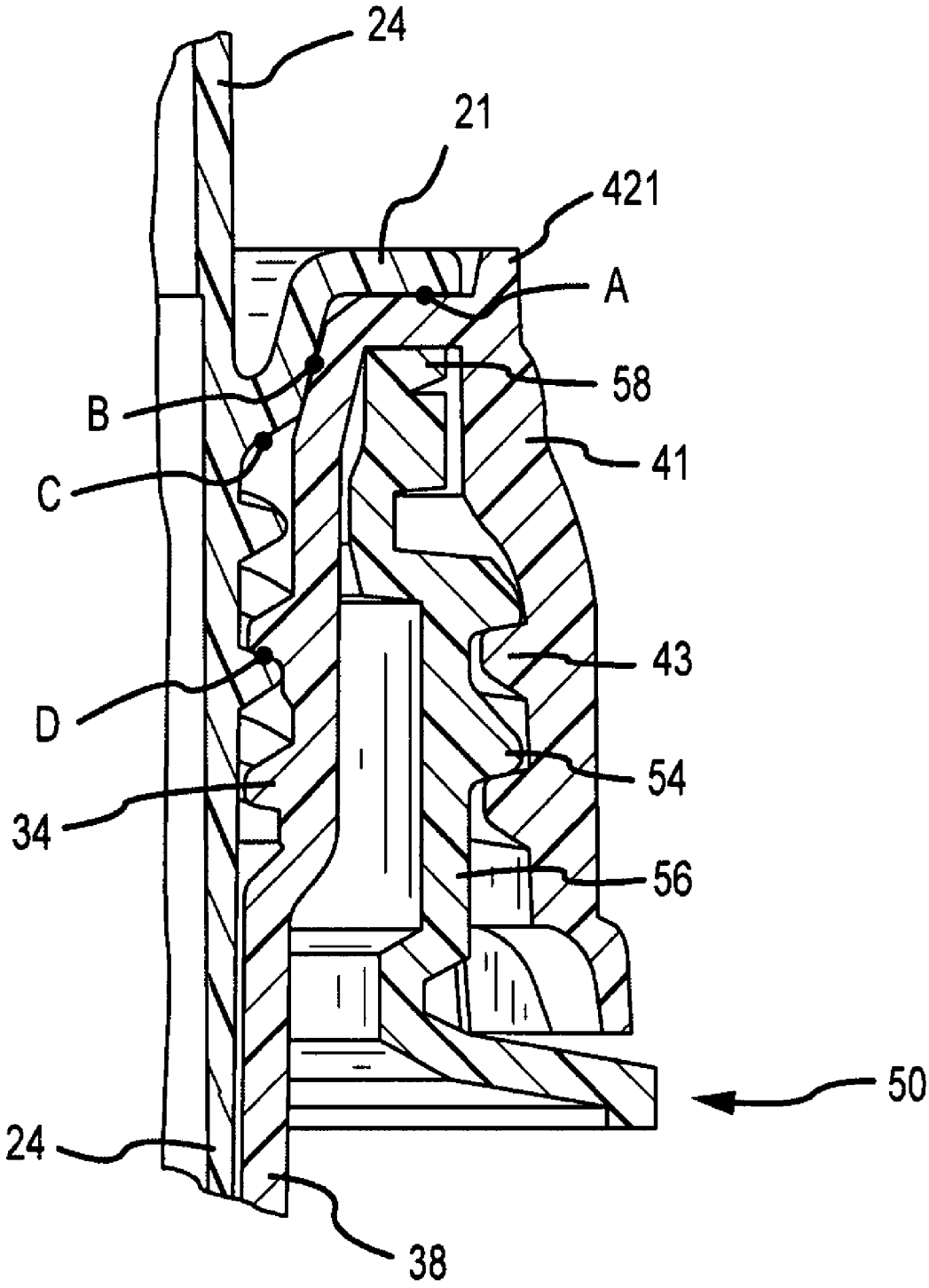
FIG. 10 is an expanded cross-sectional view of the merger between a preferred cup/closure, fitment and neck of a bottle in the present invention, further showing critical interferences that are seal points between the cup/closure and the fitment in the present invention.

FIG. 10 shows an expanded region in cross-section of the mating area between the cup/closure, the fitment, and the neck of the bottle. Most importantly, FIG. 10 shows the sealing points within the present invention. Referring to FIG. 10, bottle 50 is comprised of substantially vertical neck 56, external threads 54 and upper edge 58. External neck threads 54 are configured to mesh with fitment threads 43 that are molded under the skirt of the fitment. The thread cross-sectional designs may be as indicated in FIG. 10 to ensure a seal between the neck of the bottle and the fitment. Central to the present invention is how the cup/closure seals to the fitment. To that end, and as shown in FIG. 10, "A" designates the interface between the lower surface 28 of flange 21 on the cup/closure, and the recessed shelf 42 of the fitment (best seen in FIGS. 4 and 5). Interference "B" is the most critical of the sealing points in the present invention. "B" designates the collision of bevel 27 of the cup/closure (best seen in FIG. 8) with the inner beveled surface 37 of the fitment (best seen in FIG. 5). Recall that a difference in the angles of these bevels, and optionally different hardness of the two plastic pieces, help this interference become a liquid-tight seal. Interference "C" indicates the fit between surface 26 of the cup/closure (best seen in FIG. 8) with the top slope of the fitment thread 341 (best seen in FIG. 11). Lastly, interference "D" designates the fit between the top of the cup/closure thread 22 (best seen in FIG. 8) and both the underside 343 of the thread 34 of the fitment and the offset vertical surface 344 in the well of the fitment (both 343 and 344 best seen in FIG. 11). Also recall that the offset surface 344 and the forcing of thread 22 underneath surface 343 of thread 34 and against offset surface 344 effectively lock the cup into the fitment with even minimum hand-applied torque. Indeed, the user will feel something similar to a "detent" when turning the cup/closure the last several degrees when tightening. The mating of the cup threads and the inner fitment threads in this manner help hold the torque of the cup. More precisely, the pushing up of the cup threads against the underside of the fitment threads helps keep the cup screwed onto the fitment tightly.

Figure 11:
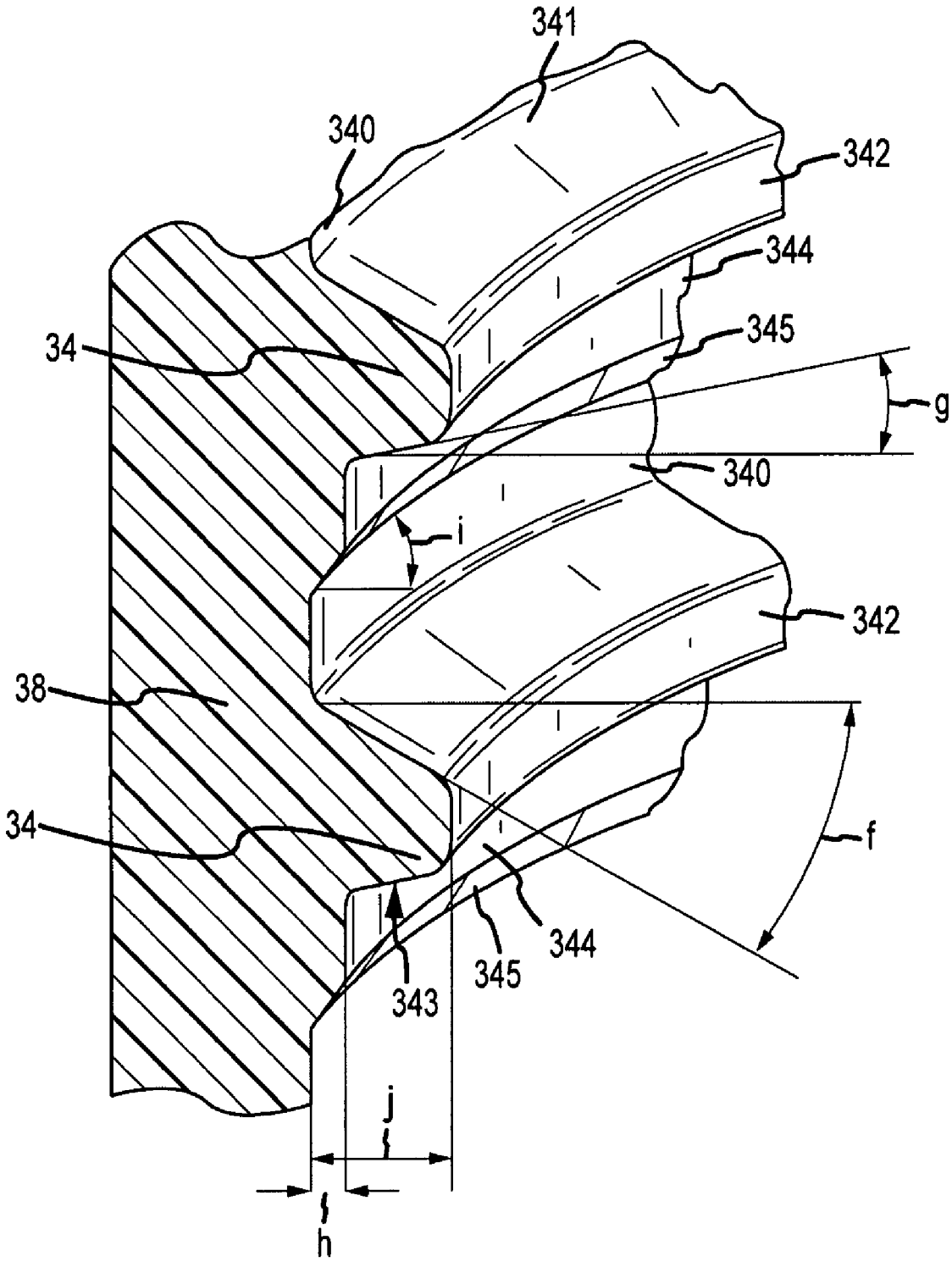
FIG. 11 is a detailed cross-sectional representation of the threads within the well of a preferred fitment of the present invention that mate with cup/closure threads.

FIG. 11 depicts the internal threads 34 within the well of the fitment 30 of the present invention in much greater detail. The thread profile form of threads 34 is a salient feature of the present invention and this thread profile helps pull the cup/closure down into more of a "locked" position with minimal torque from the consumer manually screwing the cup/closure back onto the fitment after use. As will be discussed below, as the cup/closure is pulled into the fitment by this thread configuration, certain surfaces mate to hold torque and reduce loosening. As shown in FIG. 11, threads 34 are comprised of several contiguous surfaces that form important angles and offsets. Threads 34 have a first angled top surface 341 that begins from the substantially vertical inner surface 340 of the sidewall 38, which is angled off from horizontal by angle "f". Angle "f" is preferably from about 20° to about 70° from horizontal. Top angled surface 341 molds contiguously with substantially vertical thread surface 342. Substantially vertical thread surface 342 molds contiguously with the second angled surface 343, the angle of which is designated "g" and is preferably from about 1° to about 45° from vertical. It is most preferred that angle "g" is less than angle "f", and most preferred is that angle "g" is from about 1° to about 35° and that angle "f" is from about 15° to about 50°. Angled surface 343 molds contiguously back to a second substantially vertical wall surface 344 that is "offset" in spatial orientation from first substantially vertical inner wall surface 340 by an offset indicated as "h". Offset "h" is preferably from about 10% to about 50% of the length "j" that the furthest extended vertical thread surface 342 is horizontally juxtaposed from the innermost vertical wall surface 340. Finally, substantially vertical surface 344 molds contiguously back to vertical inner wall surface 340 through an angled surface 345. Angled surface 345 is at angle "i" from horizontal. Although this angle "i" is not material to creating an efficient seal between the cup/closure and the fitment in the present invention, it is preferred that the angle "i" be from about 10° to about 50° from horizontal. To summarize the structure of the internal threads 34 within the fitment of the present invention and depicted in FIG. 11, each bead of the thread is comprised of five separate surfaces beginning on the top as dependent from the innermost vertical wall surface 340, each of the five thread surfaces are represented as surfaces 341 (top of thread), 342 (vertical outermost edge of thread), 343 (bottom of thread), 344 (second offset vertical surface), 345 (connection surface back to innermost vertical wall surface 340. Summarizing the angles for the threads: angled top surface 341 of each thread (angle "f"), angled bottom surface 343 of each thread (angle "g"), connecting surface 345 between each bottom thread surface 343 and innermost vertical wall surface 340 (angle "i"). Summarizing the distances that the threads protrude out into the well of the fitment created between the spout and the vertical inner surface: distance "j" is the furthest point out for a thread (distance from 340 to 342), and offset distance "h" (the difference between the innermost vertical wall surface 340 and the offset vertical wall surface 344). Summarizing the preferences: angles "f">"g" and offset "h" is preferably from about 10% to about 50% of the distance "j". To mate up properly with the external threads molded on the cup/closure (depicted in FIGS. 7 and 8), the internal threads 34 in the fitment may be a single continuous multi-turn thread, but more preferred is that the threads comprise at least two or three separate continuous threads to match up with the preferred three thread beads on the cup/closure. In this way there are at least two and preferably three thread start positions when engaging the cup/closure with the fitment.

As mentioned above, and now more thoroughly understood after reviewing FIGS. 10 and 11, the critical interferences in the present invention are laid out in the following table. As discussed above, the interference "B", created by the unequal angles of the two bevels, is critical to the present invention. Thereafter, sealing interference "A" is next in importance, wherein "B" and "A" are the liquid-seal points. "C" and "D" are important and contribute to holding torque between the cup and fitment and to a lesser extent the liquid sealing. That being said, it is possible for liquid to creep up the threads, but any liquid will be closed off at "B". Any liquid unexpectedly passing seal "B" is cut off from leaking at "A".

| Interference | Cup/Closure Surface | Fitment Surface | Description of the seal |
|---|---|---|---|
| "A" | 28 | 42 | Bottom surface of the cup flange sealing against the recessed circumferential shelf of the fitment. |
| "B" | 27 | 37 | First beveled inner surface underneath the cup flange sealing against the beveled surface in the fitment, with unequal angles colliding. |
| "C" | 26 | 341 | Second bevel underneath the cup flange sealing against the top surface of the fitment threads configured in the well of the fitment. |
| "D" | 22 (both top and outermost edge) | 343 and 344 | The external cup threads sealing both up underneath the bottom surface of the fitment thread and against the offset surface under each thread in the well of the fitment. |

Figure 12:
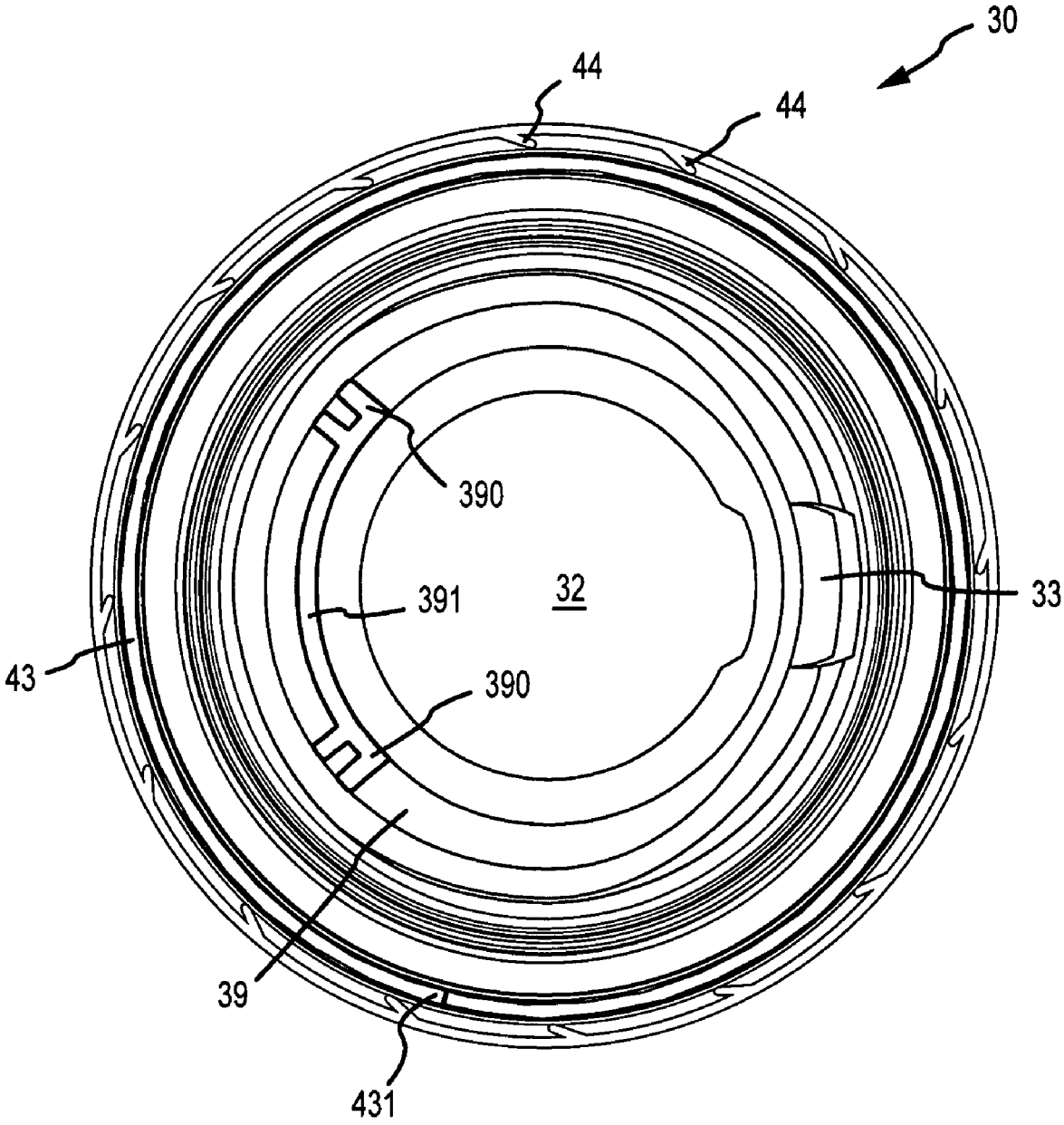
FIG. 12 is a bottom end-on view of a preferred fitment of the present invention showing a configuration of anti-rotation teeth and a thread stop that provides a locking mechanism when in concert with a locking lug on the neck of the bottle.

Lastly, the fitment 30 is designed to lock onto the neck of the bottle 50 and orient in a prescribed direction in the present invention. As shown in FIG. 1, at least one anti-rotation tooth 53 and at least one locking lug 57 ensure that the fitment "ratchets" onto the neck of the bottle and locks into the proper orientation on the bottle (for example, with the pouring spout aimed opposite to a handle on the bottle). For this to be accomplished, a single multi-turn contiguous thread is employed underneath the skirt of the fitment (threads 43 best seen in FIG. 4), along with a single complimentary multi-turn thread on the exterior of the neck of the bottle (thread 54 best seen in FIG. 1). For the locking feature to work, the threads 43 can simply "end" as a flat stop or ledge (rather than a contour) at the base of the fitment skirt. Referring now to FIG. 12, the single thread 43 inside of the fitment skirt ends in a sharp and flat "thread stop" 431 rather than a gradual decaying contour as conventional threads may. Thus, when the fitment is ratcheted onto the neck of the bottle and tightened, the sharp and flat end 431 of the thread 43 will snap over the locking lug 57 (seen in FIG. 1) ensuring that the fitment is oriented properly on the bottle. The locking lug 57 and the sharp and flat end 431 of the thread 43 can of course be placed anywhere circumferentially so long as when the thread end locks around the locking lug, the spout is orientated in the desired direction. As emphasized, there is no limit to the number of anti-rotation teeth employed in the invention. Shown in FIG. 1 are 2-sets of teeth 53 on the neck of the bottle (one set of two teeth and one set of three teeth) that engage with 16-anti-rotation teeth 44 underneath the skirt of the fitment (best seen in FIG. 12). So long as there is at least one tooth on the neck of the bottle and one engagement tooth underneath the fitment skirt, anti-rotation can be achieved. However, more teeth are preferred and the most preferred configuration shown in FIGS. 1 and 12 is to have at least one group of teeth on the neck of the bottle (e.g., two or three teeth in a group) and a symmetrical array of corresponding teeth around the underside of the skirt of the fitment (for example, circumferentially dispersed around 6, 8, 10, 12, 14, or 16 teeth are preferred, with 16-teeth 44 shown in the underside view of FIG. 12. As shown in FIG. 12, the anti-rotation teeth 44 are angled in such a way that the fitment can only be turned in one direction (e.g., clockwise) since trying to back the fitment out of its thread will cause opposition against these angled teeth. Also seen in the bottom view of the fitment 30 in FIG. 12 are the support feet 390 molded at each end of rib 391. As mentioned earlier, it is desirable for at least one support foot or similar protrusion to be molded on the bottom of the fitment so that the fitment can stand up vertically when in an automatic loading machine. Since drain-back fitments are necessarily designed with sloped bottom wells so that they can drain liquid out the drain back hole, a support foot is necessary so that the part can stand level on its own. This is particularly important when feeding plastic parts in automatic equipment in manufacturing processes. In this preferred configuration, two feet 390 are molded together with a connecting rib 391. However, there is no limit to the design of this support structure. It can be a single molded protrusion without this elaboration depicted in the figure.

We have thus described a unique design for a package comprising a drain back spout fitment, measuring cup/closure and bottle having greatly improved liquid sealing between the closure and fitment possible even with minimum applied torque. Mismatched angles of beveled surfaces are designed to form an interference fit between the fitment and closure, and unique thread configurations help hold the applied torque and maintain the liquid sealing between the pouring spout fitment and closure. A thread stop and corresponding locking lug are strategically placed on the fitment and bottle respectively to give a reproducible and reliable orientation of the fitment on the bottle. An indicia means on the skirt of the fitment gives a visible verification of the orientation of the fitment on the bottle even though the spout direction cannot be seen with the closure in place.

We claim:

1. A package for storing and dispensing liquids comprising:

a. a plastic bottle having a body and at least one opening, said opening circumscribed by an axially extending neck integral with said body, said neck having external threads;

b. a pour spout fitment sized to fit said bottle opening, said fitment having an integral central pour spout portion connected at its lowest point by an angled drain back trough to an annular collar, said collar comprising a substantially vertical inner annular wall and an exterior circumferential skirt, said inner annular wall and external skirt integrally connected across the top of said collar through a substantially horizontal shelf and internal bevel, said bevel positioned between said shelf and said inner annular wall, said inner annular wall having threads, said skirt having threads underneath for receipt on said neck of said bottle; and, c. a closure comprising a top, sidewalls, and a circumferential flange extending radially out from said sidewalls, said flange having first and second bevels stepwise connecting the underside of said flange with said sidewalls, said closure further comprising external threads positioned below said flange and said second bevel, said threads configured for receipt with said threads on said inner annular wall of said fitment, wherein an interference fit is created between said bevel on said fitment with said first bevel underneath said flange of said closure when the closure is tightened down into the fitment, and wherein said threads on said inner annular wall of said fitment are comprised of five contiguous surfaces, said surfaces further comprised of (a) a sloped top of the thread connecting the inner annular wall of the fitment out to (b) a substantially vertical outermost edge of the thread, (c) a sloped bottom of the thread connecting the substantially vertical outermost edge of the thread to (d) an offset vertical surface, and (e) a beveled surface underneath connecting said offset vertical surface back to the said vertical inner annular wall of said fitment.

2. The package in claim 1 wherein the said slope of said top of said thread is at an angle from about 15° to about 50° from horizontal, and the said slope of the bottom of said thread is at an angle from about 1° to about 35° from horizontal.

3. The package in claim 2 wherein said top of said thread is sloped at an angle from horizontal greater than the slope angle from horizontal of the bottom of said thread, and wherein said slope of bottom of said thread is at an angle less than about 20° from horizontal.

4. The package in claim 1 wherein the said offset vertical surface is offset from the inner annular wall of said fitment by a distance comprising about 10% to about 50% of the distance that said substantially vertical outermost edge of said thread protrudes out from said inner annular wall.

5. The package in claim 1, wherein said collar of said fitment further comprises a plurality of grip ribs on the said exterior skirt, and wherein the said grip ribs are positioned asymmetrically around said external skirt such that they form an indicia means that mark the direction of said pour spout.

* * * * *